US008758571B2

(12) United States Patent
Lövgren et al.

(10) Patent No.: US 8,758,571 B2
(45) Date of Patent: Jun. 24, 2014

(54) METHOD AND ARRANGEMENT FOR AMELIORATING THE DEWATERING IN A THIN WIRE PRESS

(75) Inventors: Hans Lövgren, Sundsvall (SE); Leif Öd-mark, Matfors (SE)

(73) Assignee: Valmet AB (SE)

( * ) Notice: Subject to any disclaimer, the term of this patent is extended or adjusted under 35 U.S.C. 154(b) by 0 days.

(21) Appl. No.: 13/996,897

(22) PCT Filed: Dec. 15, 2011

(86) PCT No.: PCT/SE2011/000230

§ 371 (c)(1),
(2), (4) Date: Jun. 21, 2013

(87) PCT Pub. No.: WO2012/087214

PCT Pub. Date: Jun. 28, 2012

(65) Prior Publication Data

US 2013/0277003 A1 Oct. 24, 2013

(30) Foreign Application Priority Data

Dec. 22, 2010 (SE) ..... 1051365

(51) Int. Cl.

| | |
|---|---|
| ***D21F 1/66*** | (2006.01) |
| ***D21F 1/80*** | (2006.01) |
| *D21F 9/00* | (2006.01) |
| *D21C 9/18* | (2006.01) |

(52) U.S. Cl.
CPC .. *D21F 1/66* (2013.01); *D21F 1/80* (2013.01); *D21F 9/003* (2013.01); *D21C 9/18* (2013.01)
USPC ..... 162/358.1; 162/202

(58) Field of Classification Search
CPC ..... D21C 9/18; D21F 1/66; D21F 1/80; D21F 9/003
USPC ..... 162/202, 358.1
See application file for complete search history.

(56) References Cited

U.S. PATENT DOCUMENTS

| | | | |
|---|---|---|---|
| 4,544,447 | A | 10/1985 | Pinter et al. |
| 4,659,432 | A | 4/1987 | Stenberg |
| 5,545,333 | A | 8/1996 | Louden et al. |
| 6,338,773 | B1 | 1/2002 | Sbaschnigg et al. |
| 2004/0060679 | A1 | 4/2004 | Shimazu |

FOREIGN PATENT DOCUMENTS

| | | | |
|---|---|---|---|
| EP | 0371786 | A2 | 6/1990 |
| SE | 463131 | B | 10/1990 |
| SE | 527778 | C2 | 6/2006 |
| WO | 2009145697 | A1 | 12/2009 |

OTHER PUBLICATIONS

International Search Report and Written Opinion for Application No. PCT/SE2011/000230 dated Apr. 2, 2012.

*Primary Examiner* — Jacob Thomas Minskey
(74) *Attorney, Agent, or Firm* — Lerner, David, Littenberg, Krumholz & Mentlik, LLP

(57) ABSTRACT

A method and apparatus for processing pulp is disclosed including opposed endless wires conveyed in the same direction and defining a web-forming space therebetween for dewatering the web, a pair of perforated dewatering tables supporting the endless wires for pressing the wires towards the web, the first perforated dewatering table ending upstream of the second perforated dewatering table, and a press roll downstream of the back end of the first perforated dewatering table and opposed to the back end of the second perforated dewatering table to form a nip between the press roll and the back end of the second perforated dewatering table, which has a profiled surface that interacts with the press roll to prolong the nip between the press roll and the back end of the second perforated dewatering table.

8 Claims, 3 Drawing Sheets

METHOD AND ARRANGEMENT FOR AMELIORATING THE DEWATERING IN A THIN WIRE PRESS

CROSS-REFERENCE TO RELATED APPLICATIONS

The present application is a national phase entry under 35 U.S.C. §371 of International Application No. PCT/SE2011/000230 filed Dec. 15, 2011, published in English, which claims priority from Swedish Application No. 1051365-3 filed Dec. 22, 2010, all of which are incorporated herein by reference.

FIELD OF THE INVENTION

The present invention relates to apparatus in a pulp process, and in particular the invention relates to apparatus and methods for improving the dewatering in a twin wire press arrangement.

BACKGROUND OF THE INVENTION

In pulp treating processes, pulp may be washed and dewatered in order to raise its consistency for a subsequent treatment stage. In some processes, the pulp is in the form of a web and may be treated in steps. In twin wire presses, the pulp web to be dewatered is located between two opposed wires which are pressed towards each other by means of perforated "tables" (plates/foils) and subsequent press rolls, such that the web may be dewatered through the permeable wires and further through the surface of the plates. Twin wire presses are commonly used for dewatering of pulps with an inlet consistency of approximately 3-10%. Pulp to be dewatered in twin wire presses is often pulp produced in a mechanical pulping process.

Conventionally, in a twin wire press for handling pulp, plates/foils and press rolls are combined although separated, and often a table dewatering section is followed by a press roll arrangement such that the wires pass directly from the table dewatering section to a series of nips formed between opposed press rolls. This arrangement is advantageous because in a nip formed between two press rolls the pressure may be much greater than in a table dewatering section. Hence, a first dewatering step is accomplished in a table dewatering section between two tables, wherein a second, more intense, dewatering is performed in a subsequent press roll arrangement involving at least two press rolls forming a nip between them. The table dewatering section is arranged in such a way that a wedge-shaped dewatering zone is created between the tables.

In a table dewatering section, the pressure between the tables may not go above a certain level, in order to prevent the wires from slipping with respect to each other. If the pressure between the tables becomes too high, a higher load on the drive roll is required which leads to higher friction. The higher friction may cause slipping in the drive roll nip which may cause the wires to slip with respect to each other in the table section. In the subsequent press roll arrangement, on the other hand, the risk of the wires slipping is minimal, especially since the wires rotate with the press rolls. Instead, the limitation in a press roll nip is that the dewatering degree may not be put too high in order not to scatter the pulp web. If the pressure between the press rolls is too high in comparison to the water content in the web, there will not be room for all of the water to be removed through the wires. Instead, part of the water will be pushed backwards through the web, such that the fiber web network may be broken, which will lead to subsequent delamination of the fiber web once outside of the nip (on the other side of the nip). The higher the pressure, the more influential the backward flow will be and the higher the risk of separation of the web. Therefore, conventionally, the first press roll nip in the press roll arrangement has to be arranged such that the risk of breaking the pulp web network is minimised, i.e. with a relatively low pressure and a low degree of dewatering. In fact, the first press nip of the press roll arrangement is therefore generally not very efficient. Instead, the object of the first press nip is to reduce the water content of the nip sufficiently such that a more efficient dewatering may be accomplished in the following press roll nip(s).

A problem with conventional dewatering table sections is hence that the dewatering achieved in them is too low, such that e.g. the first following press roll nip is dedicated to adapting the water content of the pulp web instead of efficiently decreasing it. In fact, this means that the first press roll nip is not efficiently used. This is a problem, since each press roll pair constitutes a large investment that should be utilised in full to bear its own costs.

Swedish Patent Specification No. 527,778 discloses an apparatus in which a press roll is arranged at the back end of the dewatering table section to provide an additional pressing force to improve the dewatering capacity of the arrangement. This arrangement includes a clear advantage over the prior art with respect to the dewatering degree. However, there are some limitations regarding the flexibility of this arrangement. In Swedish Patent Application No. 527,778 it is possible to adapt the force by moving the press roll towards or away from the opposed press table. In this respect the arrangement resembles a conventional press roll nip, including the risk of breaking the pulp web fiber network.

Also, the arrangement of Swedish Patent Application No. 527,778 allows little flexibility with respect to the possibility of adapting the dewatering degree of the press nip in accordance to the incoming consistency of the pulp. If the consistency of the incoming pulp increases from a given consistency to a somewhat higher consistency, i.e. the water content of the pulp increases, the force of the press roll needs to be released in order not to break the pulp web fiber network. Such an adjustment also reduces the dewatering degree of the press nip markedly, such that the possible dewatering degree of the nip between the press roll and the dewatering table becomes strongly dependent of the consistency of the incoming pulp, with little possibility to maximise the dewatering.

Therefore, there is a need of further ameliorating the dewatering degree of the table dewatering section arrangement, e.g. such that one pair of at least two following press roll pairs may be omitted. Alternatively, instead of omitting a pair of press rolls, the consistency out of the press may be increased. Another alternative which is enabled once the dewatering degree of the table dewatering section is ameliorated according to the present invention, is to ease the load on the table section which leads to less friction from the tables. It is desirable to be able to adapt the dewatering degree to a greater extent regardless of the consistency of the incoming pulp.

One object of the present invention is to provide apparatus and a method that enables an improved dewatering in a table dewatering section of a twin wire press.

SUMMARY OF THE INVENTION

According to one embodiment of the present invention, this and other objects have now been realized by the invention of pulp processing apparatus comprising a first endless wire, a second endless wire opposed to the first endless wire, the first and second endless wires being conveyed in the same conveying direction to define a web-forming space therebetween for dewatering a web pulp, first and second perforated dewatering tables supporting the first and second endless wires, respectively, for pressing the first and second endless wires towards the web, both of the first and second perforated dewatering tables having a front end and a back end with respect to the conveying direction of the first and second endless wires, the back end of the first perforated dewatering table being upstream of the back end of the second perforated dewatering table, and a press roll downstream of the back end of the first perforated dewatering table, the press roll being opposed to the back end of the second perforated dewatering table, so as to form a nip between the press roll and the back end of the second perforated dewatering table, the back end of the second perforated dewatering table including a profiled surface that interacts with the press roll so as to prolong the nip between the press roll and the back end of the second perforated dewatering table. In a preferred embodiment, the profiled surface is located upstream of the press roll with respect to the conveying direction of the first and second endless wires and includes a slope away from the press roll and having substantially the same curvature as the surface of the press roll. In another embodiment, the slope away from the press roll has a slightly wider curvature than the press roll.

In accordance with another embodiment of the apparatus of the present invention, the profiled surface of the back end of the second perforated dewatering table includes a protruding portion located upstream of the press roll with respect to the conveying direction of the first and second endless wires, and the protruding portion of the profiled surface includes a back side forming the slope away from the opposed press roll.

In accordance with another embodiment of the apparatus of the present invention, the profiled surface of the back end of the second perforated dewatering table includes a depression located opposite the press roll with respect to the conveying direction of the first and second endless wires, wherein the depression includes a front side facing the press roll which forms the slope away from the opposed press roll.

In accordance with another embodiment of the apparatus of the present invention, the press roll is movably disposed so that it may be moved in the conveying direction of the first and second endless wires to and from the profiled surface in order to alter the profile of the nip. In a preferred embodiment, the back end of the second perforated dewatering table is substantially straight, and is parallel to the opposed parts of the first and second perforated dewatering tables.

In accordance with another embodiment of the apparatus of the present invention, the apparatus includes at least one pair of opposed press rolls on opposing surfaces of the first and second endless wires providing at least one further nip downstream of the first and second dewatering tables.

In accordance with the present invention, a method has also been devised for processing a fiber web in a space between first and second endless wires, including conveying the first and second endless wires in a conveying direction for a predetermined distance, supporting the first and second endless wires by first and second perforated dewatering tables, respectively, pressing the first and second endless wires towards the web therebetween by means of the first and second perforated dewatering tables, each of the first and second perforated dewatering tables including a front end and a back end with respect to the conveying direction of the first and second endless wires, and pressing the first and second endless wires towards each other in a nip formed between a press roll located downstream of the back end of the first perforated dewatering table and the back end of the second perforated dewatering table, the back end of the second perforated dewatering table having a profiled surface at least partly corresponding to the surface of the opposed press roll and interacting with the press roll to prolong the nip between the press roll and the back end of the second perforated dewatering table.

According to a another embodiment of the present invention, the pulp processing apparatus hereof includes a first endless wire and an opposed endless second wire, which wires are conveyed in a same conveying direction to define a web forming space between them, in which space pulp in the form of a web is to be dewatered, wherein both wires are supported by a first and a second perforated dewatering table, respectively, for pressing the wires towards the web, both tables having a front end and back end with respect to the conveying direction of the wires and wherein the first dewatering table of the two ends upstream of the second table and that the arrangement includes a press roll downstream of the back end of the first table, which press roll is opposed the back end of the second table so as to form a nip between the press roll and the back end of the second table. The back end of the second table has a profiled surface that interacts with the press roll so as to prolong the nip between the press roll and the back end of the second table.

According to another embodiment of the present invention a method is provided for processing a fiber web in a space between an first endless wire and an opposed endless second wire, including the steps of:

conveying both wires in a conveying direction for a certain length, supporting said wires by a first and a second perforated dewatering table respectively, pressing the wires towards the web by means of said dewatering tables both tables having a front end and back end with respect to the conveying direction of the wires, and at the back ends of the tables, pressing the wires towards each other in a nip formed between a press roll, which is located downstream of the back end of the first table and the back end of the second table. The back end of the second table has a profiled surface that at least partly corresponds to the surface of the opposed press roll and that interacts with the press roll so as to prolong the nip between the press roll and the back end of the second table.

With the invention according to the first and second aspect the efficiency of the dewatering will be markedly ameliorated. This is due to the fact that the prolongation of the nip that is achieved by the inventive arrangement and method increases the dewatering effect of the nip to a degree that at least partly corresponds to the achieved nip prolongation.

BRIEF DESCRIPTION OF THE DRAWINGS

The present invention, and further objects and advantages of it, is best understood from the following detailed description, with reference to the appended drawing, of which.

DETAILED DESCRIPTION

Figure 1:
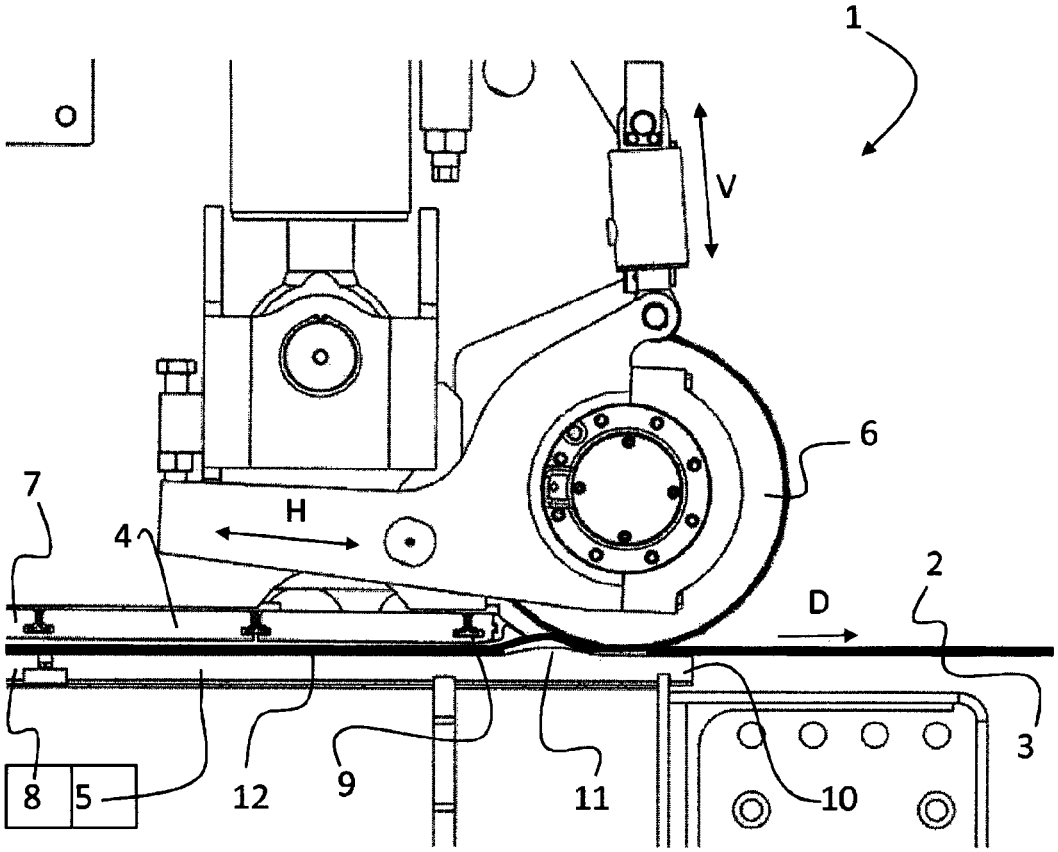
FIG. 1 is a side, elevational, schematic illustration of an exemplary embodiment the present invention.
Figure 2:
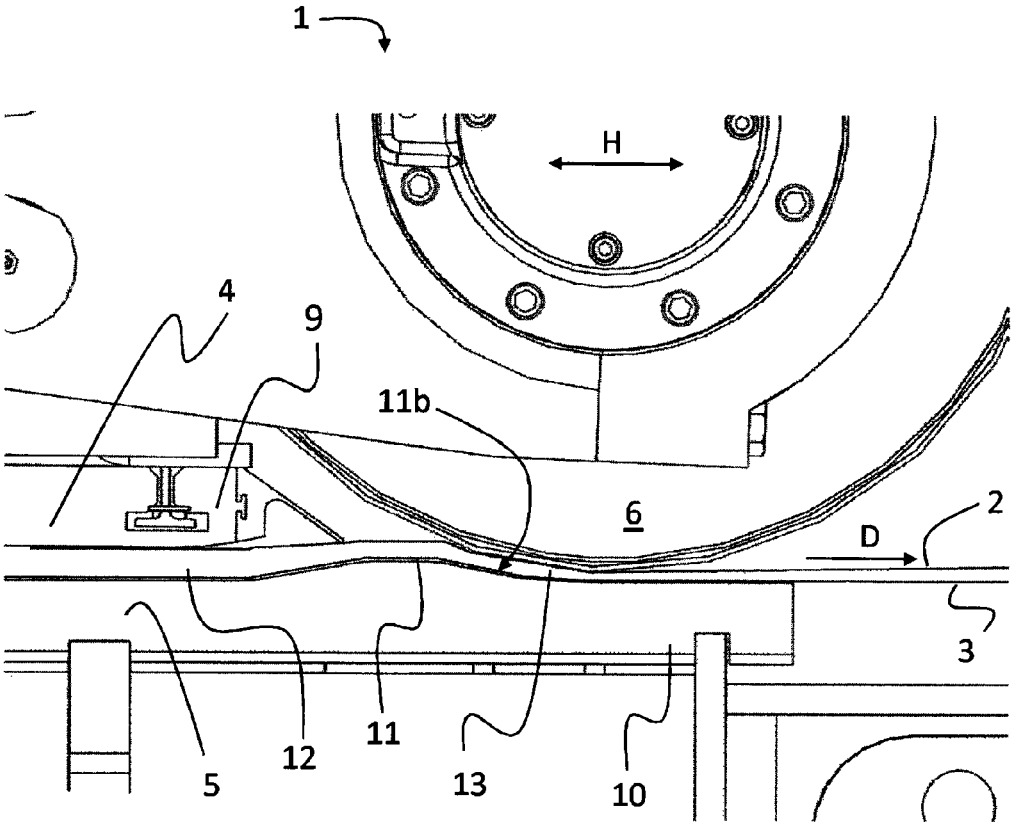
FIG. 2 is a side, elevational, enlarged view of the exemplary embodiment of FIG. 1.

FIG. 1 schematically shows a pulp processing arrangement 1 including an first endless wire 2, e.g. the upper in the figures, and an opposed lower endless second wire 3, which wires are conveyed in a same conveying direction D and define a web forming space 12 between them in which a pulp web to be dewatered is located. Both wires 2 and 3 are supported by a first and a second perforated dewatering table 4 and 5, respectively, for pressing the wires 2 and 3 towards the web. The first table 4, e.g. the upper in the figures, has a front end 7 and back end 9 with respect to the conveying direction D of the wires. Correspondingly, the second table 5, e.g. the lower in the figures, has a front end 8 and back end 10 with respect to the conveying direction D of the wires.

In the pulp processing arrangement 1 according to the invention the first dewatering table 4 includes a press roll 6 at its back end 9, which press roll 6 is opposed the back end 10 of the second table 5 so as to form a nip 13 between the press roll 6 and the back end 10 of the second table 5. This arrangement gives rise to an apparent improvement of the dewatering of the pulp web because of the elevated pressure at the nip. Further, the back end 10 of the second table 5 has a profiled surface that interacts with the press roll 6 so as to prolong the nip 13 between the press roll 6 and the back end 10 of the second table 5. In fact, the profiled surface of the back end 10 of the second table 5 opposing the press roll 6 fills two purposes; firstly, it serves to prolong the nip such that the effect of the dewatering may be improved, secondly however and just as important, the profiled surface acts as a support to the pressure from the press roll, such that the risk that the wires should slip is heavily reduced.

In the shown embodiment, the profiled surface includes a protruding part 11, which is located upstream of the press roll 6 with respect to the conveying direction D of the wires 2 and 3. Further, the protruding part 11 is so located that it interacts with the press roll 6 so as to prolong the nip 13 between the press roll 6 and the back end 10 of the second table 5.

The protruding part 11 includes an away slope 11*b* formed by the back side of the protruding part 11, which away slope faces the press roll 6. In the figure, the away slope 11*b* is in fact a down slope with respect to the press roll. However, the invention also includes embodiments where the press roll is arranged at a lower press table opposed to an upper table. Hence the term "away slope" is in this application utilised to denote a part of the profiled surface of the second table that slopes away from the imaginary extension of the opposed first table.

Preferably, the away slope 11*b* of the back side has substantially the same curvature as the press roll, or a slightly wider curvature. In short, the profiled surface of the second table 5 should be such arranged that it provides for a smooth entry into to the press nip 13 between the press roll 6 and the back end 10 of the second table 5. With a curvature that is slightly larger than that of the circular surface of the press roll two things are achieved. Firstly, it results in that the gap between the press roll 6 and the back end 10 of the second table 5 is reduced in a smooth or soft manner towards the very nip 13, where the distance between them is at a minimum, such that the risk of friction that may cause the wires to slip with respect to each other is heavily reduced. In other words, the risk that the second wire 3 gets stuck against the table, such that the first wire 2 slips with respect to it is minimised. Secondly, the profile of the protruding part 11 contributes to a prolongation of the nip 13, which yields an improved dewatering in said nip.

As an alternative second embodiment (not shown) of the profiled surface the protruding part 11 may instead include a depression instead of a protrusion. Such a depression should be located opposite the press roll 6 with respect to the conveying direction D of the wires 2, 3, such that the depression interacts with the press roll 6 so as to prolong the nip 13 between the press roll 6 and the back end of the second table 5. Hence, the front side of the depression would then correspond to the away slope of the back side 11*b* of the protruding part 11. Also, the depression may include an up slope, i.e. a portion that levels up the table to the same level as that upstream of the depression (not shown). However, this up slope may also be omitted, such that the back end of the table is straight and parallel to, but lower than the rest of the table.

The common feature of the two embodiments is thus the away slope 11*b*, which due to its at least partial correspondence to the surface of the press roll results in a prolonged nip, which in turn results in a more effective dewatering. It is to be noted that the partial correspondence to the surface of the press roll includes embodiments where the away slope has a different curvature than that of the roll as well as embodiments where the away slope is essentially straight (i.e. not designed having a curvature with a radius) or arranged to be stepwise altered.

An advantage of the embodiments where the second table 5 has a straight back end 10, i.e. a back end with no up slope, is that they allow for an adjustment of the nip 13. Namely, the press roll 6 may be movably arranged such that it may be moved in a horizontal direction H, which corresponds to the conveying direction D of the wires 2, 3 to and from the profiled surface, in order to alter the profile of the nip 13. If the press roll is moved towards the away slope 11*b*, the angle into the nip 13 will be steeper, whereas if the press roll is moved away from the away slope 11*b* the angle will be gentler.

Hence, with the embodiments without an up slope there are two different manners of affecting the nip. In the first manner, which is more conventional, the pressure at the nip 13, i.e. the force with which the press roll 6 acts on the opposed table may be adjusted by raising and lowering the press roll 6 in the vertical direction V. The second manner of adjusting the nip is achieved by moving the press roll 6 back and forth in the horizontal direction H, which direction of course coincides with the conveying direction D of the wires 2, 3. As indicated above, this second adjustment makes it possible to alter the length of the nip and the entrance angle into the nip; the closer the press roll 6 is to the protruding part 11, the steeper the entrance angle and the shorter the nip will be. Correspondingly, the farther away the press roll 6 is to the protruding part 11, the gentler the entrance angle and the longer the nip will be.

Figure 3:
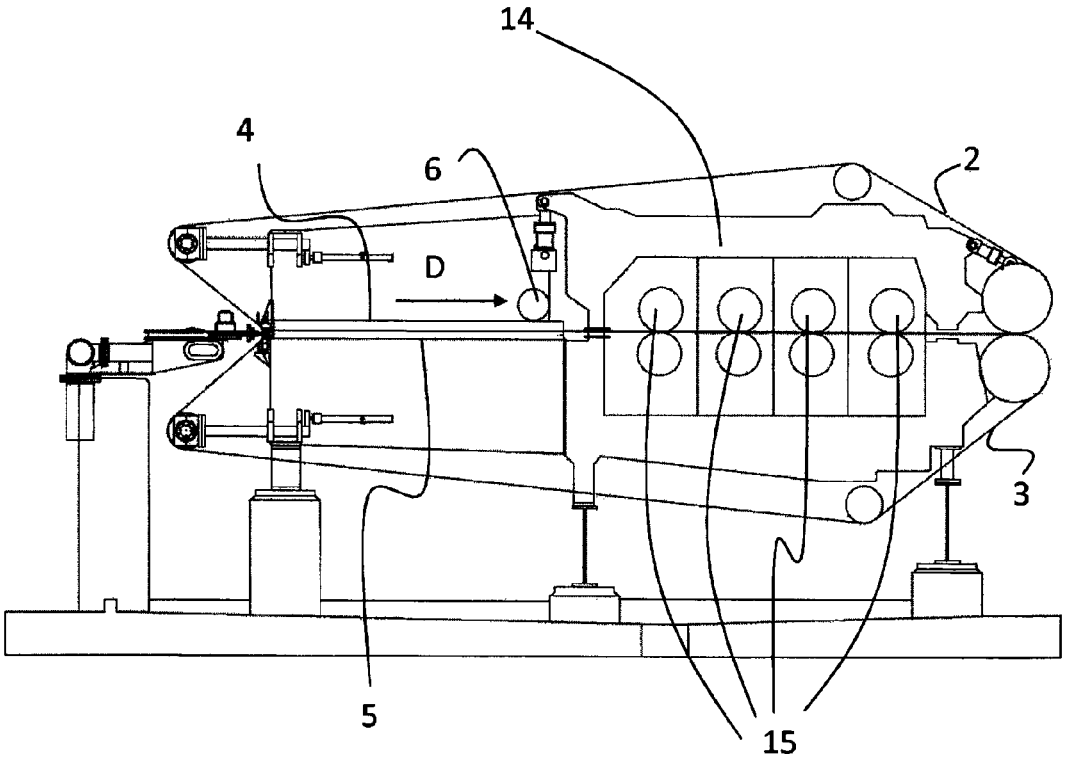
FIG. 3 is a side, elevational, schematic illustration of a twin wire press comprising a dewatering table section and a press roll arrangement.

Conventionally, a twin wire table dewatering section is followed by an arrangement 14 of press rolls 15 for further dewatering of the web between the wires, as illustrated in FIG. 3. The arrangement according to the invention includes at least one further nip, downstream of the dewatering tables 4, 5, formed by two opposed press rolls between which the wires 2, 3 are conveyed. A great advantage of the invention is however that the dewatering at the table section will be so much more efficient than in a conventional table section that one of the following press roll nips, e.g. the first press nip of the press roll arrangement 14, may be omitted. Alternatively, the increased dewatering efficiency may be used to increase the consistency out of the dewatering apparatus without increasing the number of roll pairs in the press arrangement.

Above, specific embodiments of the invention have been described with reference to the schematic drawings. The invention is however not limited by either of these. Instead, the invention is only limited by the scope of the following claims.

The invention claimed is:

1. A pulp processing apparatus comprising a first endless wire, a second endless wire opposed to said first endless wire, said first and second endless wires being conveyed in the same conveying direction to define a web-forming space therebetween for dewatering a web pulp, first and second perforated dewatering tables supporting said first and second endless wires, respectively, for pressing said first and second endless wires towards said web, said first and second perforated dewatering tables including a front end and a back end with respect to said conveying direction of said first and second endless wires, said back end of said first perforated dewatering table being upstream of said back end of said second perforated dewatering table, and a press roll downstream of said back end of said first perforated dewatering table, said press roll being opposed to said back end of said second perforated dewatering table so as to form a nip between said press roll and said back end of said second perforated dewatering table, said back end of said second perforated dewatering table including a profiled surface that interacts with said press roll so as to prolong said nip between said press roll and said back end of said second perforated dewatering table wherein said profiled surface is located upstream of said press roll with respect to said conveying direction of said first and second endless wires includes a slope away from said opposed press roll and having substantially at least the same curvature as the surface of said press roll.

2. The apparatus of claim 1 wherein said slope has a slightly wider curvature than the surface of said press roll.

3. The apparatus of claim 1 wherein said profiled surface of said back end of said second perforated dewatering table includes a protruding portion located upstream of said press roll with respect to said conveying direction of said first and second endless wires, and wherein said protruding portion of said profiled surface includes a back side forming said slope away from said opposed press roll.

4. The apparatus of claim 1 wherein said profiled surface of said back end of said second perforated dewatering table includes a depression located opposite said press roll with respect to the conveying direction of said first and second endless wires, wherein said depression includes a front side facing said press roll which forms said slope away from said opposed press roll.

5. The apparatus of claim 1 wherein said press roll is movably disposed so that it can be moved in the conveying direction of said first and second endless wires to and from said profiled surface in order to alter the profile of said nip.

6. The apparatus of claim 5 wherein said back end of said second perforated dewatering table is substantially straight, and is parallel to the opposed portions of said first and second perforated dewatering tables.

7. The apparatus of claim 1 including at least one pair of opposed press rolls on opposing surfaces of said first and second endless wires providing at least one further nip downstream of said first and second perforated dewatering tables.

8. A method of processing a fiber web between a space between first and second endless wires including conveying said first and second endless wires in a conveying direction for a predetermined distance, supporting said first and second endless wires by first and second perforated dewatering tables, respectively, pressing said first and second endless wires towards the web therebetween by means of said first and second perforated dewatering tables, each of said first and second perforated dewatering tables including a front end and a back end with respect to said conveying direction of said first and second endless wires, and pressing said first and second endless wires towards each other in a nip formed between a press roll located downstream of the back end of said first perforated dewatering table and the back end of said second perforated dewatering table, the back end of said second perforated dewatering table having a profiled surface at least partially corresponding to the surface of the opposed press roll and interacting with the press roll so as to prolong the nip between said press roll and the back end of said second perforated dewatering table, wherein said profiled surface is located upstream of said press roll with respect to said conveying direction of said first and second endless wires includes a slope away from said opposed press roll and having substantially at least the same curvature as the surface of said press roll.

* * * * *